United States Patent [19]

Larsen

[11] Patent Number: 5,056,707

[45] Date of Patent: Oct. 15, 1991

[54] PACKAGING

[75] Inventor: Per O. Larsen, Oslo, Norway

[73] Assignee: Elopak Systems A.G., Glattbrugg, Switzerland

[21] Appl. No.: 467,159

[22] Filed: Jan. 19, 1990

[30] Foreign Application Priority Data

Jan. 21, 1989 [GB] United Kingdom ..... 8901319

[51] Int. Cl.[5] ..... B65D 5/42

[52] U.S. Cl. ..... 229/104; 229/137; 229/184

[58] Field of Search ..... 229/137, 138, 139, 184, 229/104

[56] References Cited

U.S. PATENT DOCUMENTS

| | | | |
|---|---|---|---|
| 2,070,747 | 2/1937 | Orstrom | 229/104 |
| 2,232,088 | 2/1941 | Waters | 229/164 |
| 3,586,232 | 6/1971 | Scully | 229/104 |
| 3,971,300 | 7/1976 | Bachner | 229/184 |
| 4,667,873 | 5/1987 | Yasui et al. | 229/137 |
| 4,785,993 | 11/1988 | Lisiecki | 229/137 |

FOREIGN PATENT DOCUMENTS

| | | | |
|---|---|---|---|
| 1013155 | 12/1965 | United Kingdom | 229/104 |

*Primary Examiner*—Gary E. Elkins
*Attorney, Agent, or Firm*—John C. Evans

[57] ABSTRACT

An end press for bearing against a bottom end closure of a carton sleeve received upon a mandrel has recesses formed therein at locations corresponding to corner zones of the end closure, whereby those corner zones protrude outwards, relative to respective adjacent zones of the end closure, in an outward longitudinal direction of the carton sleeve.

1 Claim, 3 Drawing Sheets

PACKAGING

BACKGROUND OF THE INVENTION

1. Field of the Invention

This invention relates to an end press for bearing against a bottom end closure of a carton sleeve, and to a carton sleeve itself.

2. Description of the Prior Art

It is conventional for liquid packing cartons made from sheet material consisting of paperboard coated on both faces with thermoplastics to have bottom end closures in which panels are folded over onto one another and heat-and-pressure-sealed to one another, whereby at least parts of the bottom end closures consist of multiple thicknesses of the sheet material. The sealing can be performed by causing the carton sleeve to be received over a mandrel onto an end surface of which the panels are folded and by causing an end press to press the panels against the end surface of the mandrel. It is known from, for example U.S. Pat. Nos. 4,761,156; 3,971,300; 3,422,730 and 3,252,386, and Swiss Patent 394786 for the end surface of the mandrel and/or the pressing surface of the end press to be formed with recesses and/or protrusions intended in most cases to be complementary to the thickeness variation of the bottom end closure.

Also, it is known from European Patent Application Publication 281206 for the pressing surface of the end press to be formed with a pyramidal protrusion extending over substantially the whole area of the bottom end closure, and for the mandrel end surface to be formed with a corresponding pyramidal recess, to give the bottom end closure a pyramidal form to promote stable seating of the carton.

The sealing pressure produced between the mandrel and the end press can cause the material, particularly the plastics, of the end closure to flow outwardly in the plane of the end closure and, particularly at the corners of the end closure, to produce outward protrusions. This displaced material can produce radially outward protrusions at the corners of the carton sleeve adjacent to the bottom end closure and such effect can cause cracking of the materials of the carton sleeve at those locations, particularly if the carton sleeve has a layer of aluminium foil at the inside surface of its paperboard.

SUMMARY OF THE INVENTION

According to a first aspect of the present invention, there is provided an end press for bearing against a polygonal end closure of a carton sleeve received upon a mandrel, said end press having respective recesses formed therein at locations corresponding to corner zones of said end closure.

According to a second aspect of the present invention, there is provided a carton sleeve having a polygonal end closure with corner zones which protrude outwards, relative to respective adjacent zones of said end closure, in an outward longitudinal direction of said carton sleeve.

Owing to the invention, material diplaced outwardly in the plane of the end closure by the sealing pressure can form longitudinally outward protrusions at the corner of the end closure.

BRIEF DESCRIPTION OF THE DRAWINGS

In order that the invention may be clearly understood and readily carried into effect, reference will now be made, by way of example, to the accompanying drawings, in which.

DESCRIPTION OF THE PREFERRED EMBODIMENT

Figure 6:
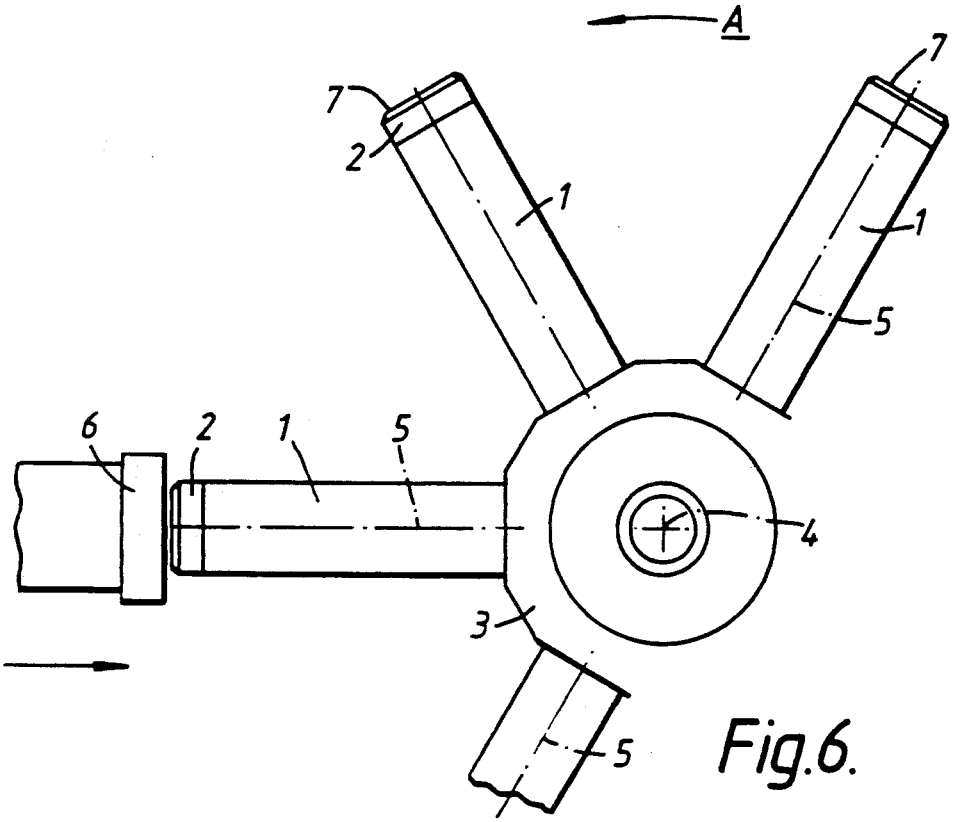
FIG. 6 is a fragmentary, diagrammatic, side elevation illustrating the co-operation between the end press and a plurality of mandrels each identical to the mandrel of FIG. 4.

Referring to FIG. 6, a plurality of mandrels 1 including respective, changeable, end caps 2 are fixed to a rotary hub 3 which is rotated stepwise about its own axis 4. The mandrels 1 are equi-angularly spaced about the axis 4 and their own respective axes 5 radially intersect the axis 4. The mandrels 1 are stepped about the axis 4 in the sense of the arrow A. At various stations (not illustrated) about the axis 4, the mandrels 1 in turn receive carton sleeves each open at both ends; the sleeves in turn have bottom end closure panels folded-in to the condition shown in FIG. 2; in turn have a hot end press 6 applied to the outside faces of the bottom end closures, to heat-and pressure-seal the end closure panels together; the sealed bottom end closures are cooled by the mandrels and in turn the carton sleeves, now closed at one end, are removed from the mandrels 1.

Figure 4:
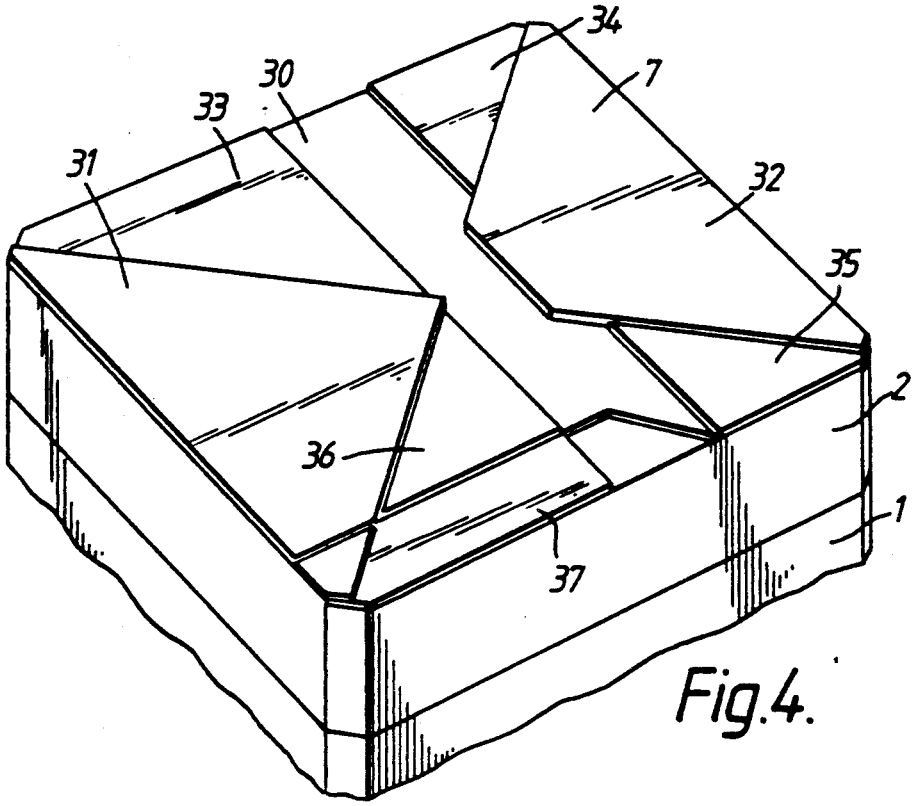
FIG. 4 shows a fragmentary perspective view of an end part of a mandrel for insertion in the carton sleeve and for use in sealing the bottom end closure.
Figure 5:
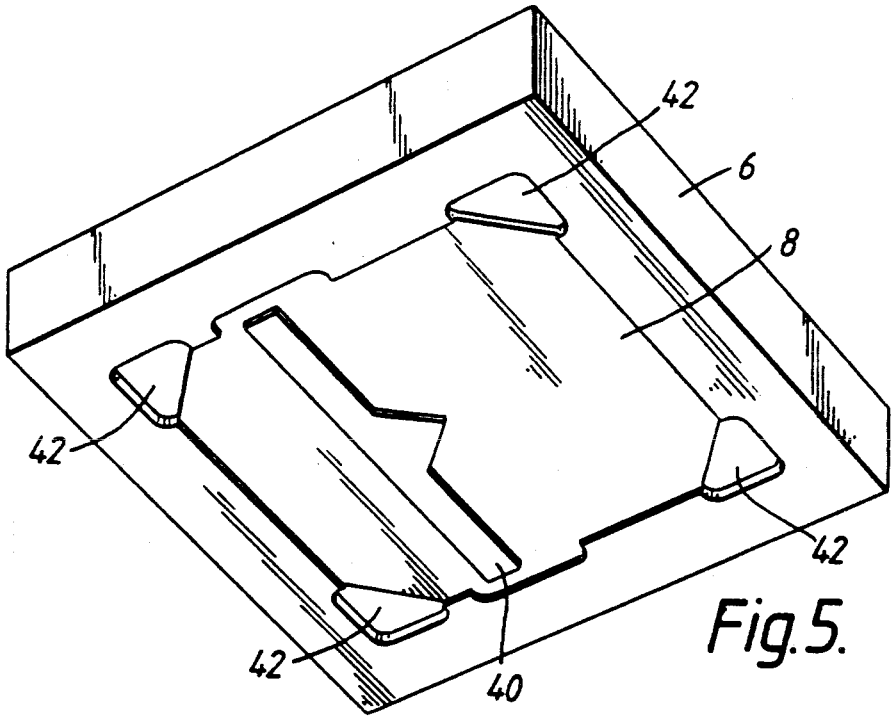
FIG. 5 shows a perspective view of an end press for use in sealing the bottom end closure of the sleeve received upon the mandrel.

Since the thickness of the end closure may vary considerably over its area, depending upon the total number of overlapping plies at any point, which may, depending upon the design of the bottom end closure, vary between one and seven or more, if the pressing face of the end press and the end face of the mandrel are planar, sealing can be poor at those points where sealing is required but the number of plies is relatively low. Therefore, the respective mandrel end faces 7 are given a profiled form in axial planes of the mandrel 1. Moreover, the end face 8 of the end press 6 is also given a profiled form in axial planes of any mandrel 1 at its station. The particular design of the profile of each end face 7 and the particular design of the profile of the end face 8 will naturally depend upon the shapes and dimensions, especially the number of plies at any one point, of the bottom end closure in question. FIGS. 4 and 5 illustrate profiles designed particularly for the bottom end closure shown in FIGS. 2 and 3 made from the blank shown in FIG. 1.

Figure 1:
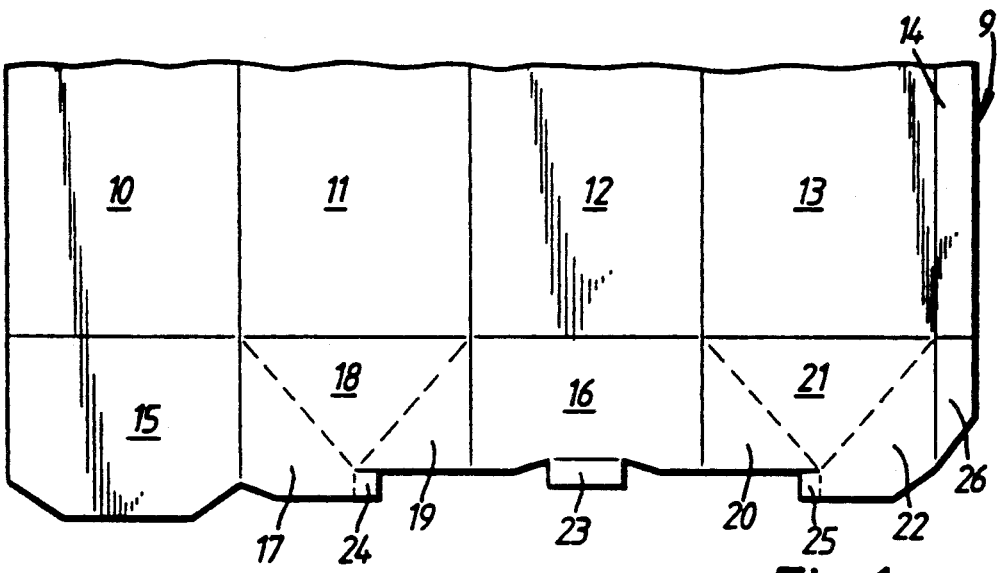
FIG. 1 shows a fragmentary plan view of part of a carton blank.

Referring to FIG. 1, the blank 9 comprises paperboard coated on both faces with thermoplastics and is of the form disclosed in British Patent Application Publication 2176767A, to which reference may be made for details that may not be clear from the following brief description. The blank comprises side wall panels 10 to 13, with a side wall sealing seam panel 14. The blank also includes bottom closure panels 15 and 16 of roughly rectangular form, bottom closure panels 17 to 22 of a triangular or roughly triangular form, a rectangular flap panel 23 integral with the panel 16, and rectangular stub panels 24 and 25 integral with the panels 17 and 22, respectively, there being also a bottom end closure sealing seam panel 26.

Figure 2:
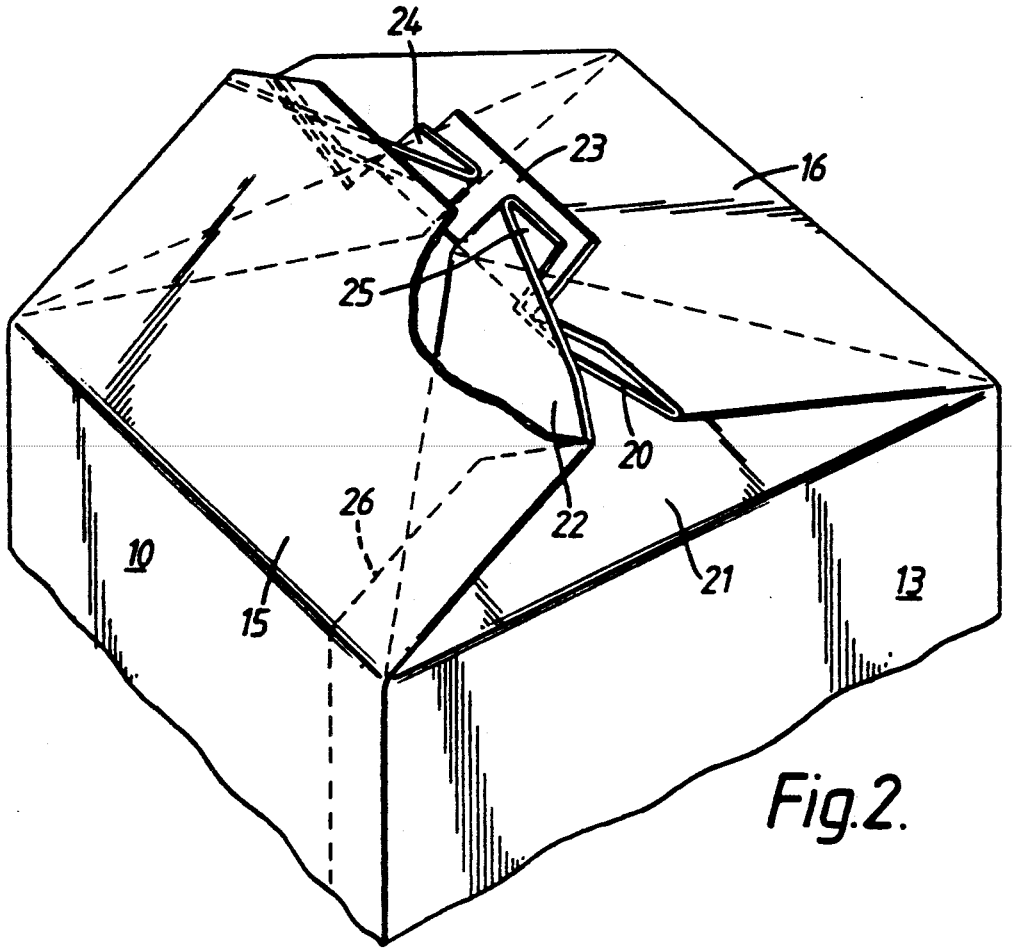
FIG. 2 shows an underneath perspective view of a bottom end closure of a carton sleeve, the closure being shown in its condition immediately prior to heat-and pressure-sealing.
Figure 3:
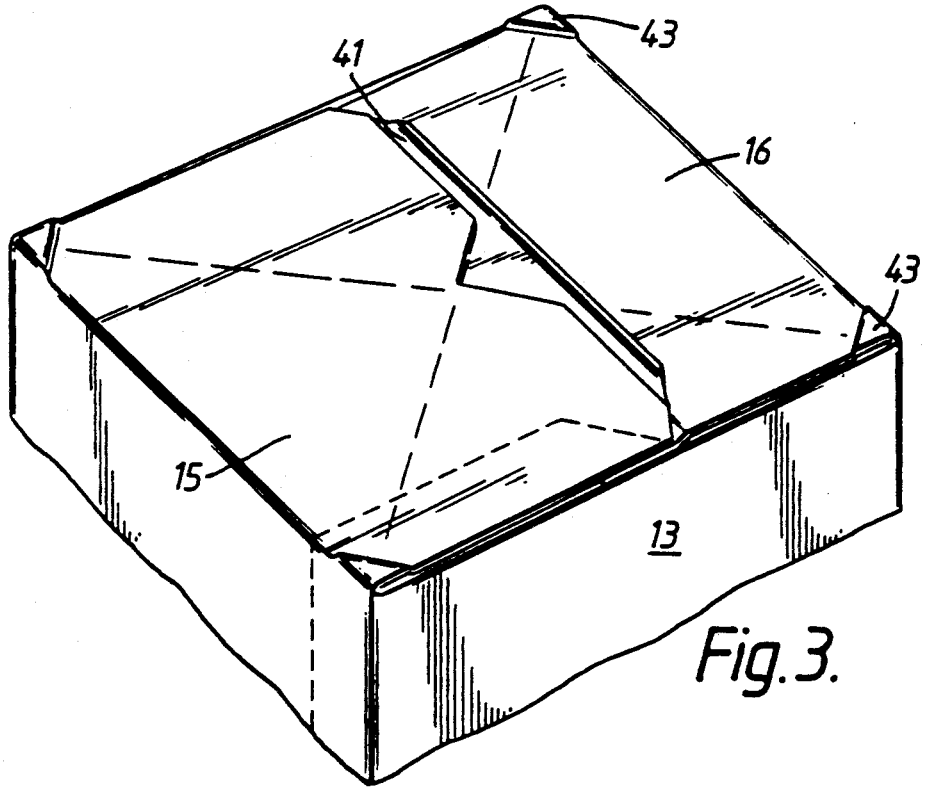
FIG. 3 is a view similar to FIG. 2, but showing the bottom end closure after heat-and pressure-sealings.

Referring to FIG. 2, it will be appreciated that the sealed end closure shown in FIG. 3 will vary in thickness from one ply (for example, at the middle part of the panel 15 adjacent to the panel 10) through other numbers of plies to seven plies (at for example the location of the stub panel 25 where, progressing inwards there are the panel 15, the panel 22, the stub panel 25, the flap panel 23, the panel 16, the panel 20 and the panel 21).

Even at the ends of the overlap between the panels 15 and 16, there is a six-ply thickness (the panel 15, the panel 26, the panel 22, the panel 16, the panel 20 and the panel 21) at one end, and a five-ply thickness ( the panel 15, the panel 17, the panel 16, the panel 19 and the panel 18) at the other end. Therefore, it is along this middle band from the side wall panel 11 to the side wall panel 13 that there is provided a corresponding deeply recessed band 30 across the end face 7 of the mandrel 1, as seen in FIG. 4. Corresponding to the single-ply thicknesses at those middle parts of the panels 15 and 16 nearest to the panels 10 and 12 are the respective highest lands 31 and 32 of the profiled end face 7. Corresponding to certain three-ply thicknesses are intermediate-height lands 33 to 36. Corresponding to the location of the sealing seam panel 26, the recess 30 and the lands 31 and 36 are slightly more deeply cut away at 37.

It is naturally important that the zone of overlap betweeen the panels 15 and 16, which is where any leakage at the bottom end-closure is most likely to occur, should be well sealed in a liquid-type manner. For this reason and as seen in FIG. 5, the corresponding zone of the end face 8 is formed with a land 40 of a plan shape, dimensions and position corresponding to the design of the end closure. This land ensures that the plies at the overlap zone are firmly pressed together for sealing. The land 40 naturally produces a recess 41 in the external surface of the sealed bottom end closure shown in FIG. 3. The land 40 is in the form of an island extending from one side to the opposite side of the end closure, whereby the recess 41 is in the form of a corresponding, isolated trough.

The sealing pressure produced between the mandrel 1 and the end press 6 can cause the material, particularly the plastics, of the end closure to flow outwardly in the plane of the end closure and, particularly at the corners of the end closure, to produce outward protrusions. If this displaced material were to produce radially outward protrusions at the corners of the carton sleeve adjacent to the bottom end closure, such effect could cause cracking of the materials of the carton sleeve at those locations, particularly if the carton sleeve has a layer of metal foil, for example aluminium foil, at the inside surface of its paper-board. In order to discourage such radially outward protrusions, the end face 8 is advantageously provided with shallow recesses 42 at its respective corner zones. With such recesses, the tendency is for the surplus material to form respective longitudinally outward protrusions 43 at the corner zones of the bottom end closure. Each recess 42 is of a size and shape to extend throughout the corner angle of the corresponding corner of the end closure, so that each protrusion 43 can extend throughout that corner angle. We have found that, with this arrangement, less cracking occurs at the corners of the bottom of the carton sleeve.

I claim:

1. A carton sleeve having a polygonal end closure with corner zones which protrude outwards, relative to respective adjacent zones of said end closure, in an outward longitudinal direction of said carton sleeve, said end closure having a zone at which panels of said end closure overlap each other and which is recessed inwards, relative to adjacent zones of said end closure, in an inward longitudinal direction of said carton sleeve, and the inward recess of said zone taking the form of an isolated trough extending transversely of said end closure from one side thereof to an opposite side thereof.

* * * * *